US009436128B2

(12) United States Patent
Buchanan et al.

(10) Patent No.: US 9,436,128 B2
(45) **Date of Patent: *Sep. 6, 2016**

(54) TONER CARTRIDGE HAVING AN ENGAGEMENT MEMBER FOR ACTUATING A SHUTTER

(71) Applicant: Lexmark International, Inc., Lexington, KY (US)

(72) Inventors: John Andrew Buchanan, Charlotte, NC (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/789,070

(22) Filed: Jul. 1, 2015

(65) Prior Publication Data

US 2015/0301479 A1 Oct. 22, 2015

Related U.S. Application Data

(63) Continuation of application No. 13/919,015, filed on Jun. 17, 2013, now Pat. No. 9,104,141.

(60) Provisional application No. 61/828,390, filed on May 29, 2013.

(51) Int. Cl.

| | |
|---|---|
| ***G03G 15/00*** | (2006.01) |
| ***G03G 15/08*** | (2006.01) |
| ***G03G 21/16*** | (2006.01) |

(52) U.S. Cl.
CPC ..... *G03G 15/0886* (2013.01); *G03G 15/0875* (2013.01); *G03G 15/0898* (2013.01); *G03G 21/16* (2013.01)

(58) Field of Classification Search
CPC ..... G03G 15/0886; G03G 15/0898
USPC ..... 399/98, 258, 262
See application file for complete search history.

(56) References Cited

PUBLICATIONS

Examination Report dated Dec. 23, 2015 for Colombian Patent Application No. 15-283965-1.
English Translation of Examination Report dated Dec. 23, 2015 for Colombian Patent Application No. 15-283965-1.

*Primary Examiner* — Quana M Grainger
(74) *Attorney, Agent, or Firm* — Justin M. Tromp

(57) ABSTRACT

A toner cartridge according to one embodiment includes an outlet port positioned on the front of a housing for exiting toner from the toner cartridge. The toner cartridge includes an engagement member having a first engagement surface and a second engagement surface. The first engagement surface is positioned proximate the rear of the housing to receive an actuation force in a frontward direction of the housing at the rear of the housing. The second engagement surface is positioned proximate the front of the housing below the outlet port. The engagement member is movable from a first position to a second position upon receiving the actuation force. As the engagement member moves from the first position to the second position, the second engagement surface moves in the frontward direction and protrudes from the front of the housing with at least a portion of the front of the second engagement surface unobstructed.

20 Claims, 9 Drawing Sheets

TONER CARTRIDGE HAVING AN ENGAGEMENT MEMBER FOR ACTUATING A SHUTTER

CROSS REFERENCES TO RELATED APPLICATIONS

This patent application is a continuation application of U.S. patent application Ser. No. 13/919,015, filed Jun. 17, 2013, entitled "Toner Cartridge Having a Shutter with Bypassing Actuation," which claims priority to U.S. Provisional Patent Application Ser. No. 61/828,390, filed May 29, 2013, entitled "Toner Cartridge having a Shutter with Bypassing Actuation," the content of which is hereby incorporated by reference in its entirety.

BACKGROUND

1. Field of the Disclosure

The present invention relates generally to electrophotographic printers and more particularly to a toner cartridge having a shutter with bypassing actuation.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll and a doctor blade are positioned in one replaceable unit (a developer unit). The image forming device's toner supply, which is consumed relatively quickly in comparison with the components housed in the developer unit, is provided in a reservoir in a separate replaceable unit in the form of a toner cartridge that mates with the developer unit. In this configuration, the number of components housed in the toner cartridge is reduced in comparison with traditional toner cartridges.

Image forming devices having a separate toner cartridge and developer unit are susceptible to leakage of toner between an outlet port of the toner cartridge and an inlet port of the developer unit. Toner leakage is most frequently experienced when the toner cartridge is separated from the developer unit and removed from the image forming device. When this occurs, handling, moving or shipping of the image forming device may cause toner to escape from the inlet port of the developer unit. Further, image forming devices having a separate toner cartridge and developer unit present an additional concern. If the developer unit is not present when the toner cartridge is installed in the image forming device, any toner exiting the cartridge will leak into the interior of the image forming device because the developer unit is not there to receive it. Leaked toner may contaminate both internal and external surfaces of the image forming device resulting in not only uncleanliness but, in some cases, reliability issues or print defects. Accordingly, it will be appreciated that a mechanism that prevents the unwanted release of toner is desired.

SUMMARY

A toner cartridge for use with a developer unit of an image forming device according to one example embodiment includes a housing having a front, a rear, a top and a bottom. The housing has a reservoir for holding toner. An outlet port is positioned on the front of the housing for transferring toner from the reservoir to the developer unit. The toner cartridge includes an engagement member having a first engagement surface and a second engagement surface. The first engagement surface is positioned proximate to the rear of the housing and positioned to receive an actuation force from an actuation feature of the image forming device when the toner cartridge is installed in the image forming device. The second engagement surface is positioned proximate to the front of the housing below the outlet port and positioned to engage a shutter on an inlet port of the developer unit when the toner cartridge is installed in the image forming device and mated with the developer unit. The engagement member is movable from a first position to a second position upon receiving the actuation force. As the engagement member moves from the first position to the second position, the second engagement surface protrudes from the front of the housing to engage the shutter of the developer unit.

A toner cartridge for use with a developer unit of an image forming device according to another example embodiment includes a housing having a front, a rear, a top and a bottom. The housing has a reservoir for holding toner. An outlet port on the front of the housing faces toward the bottom of the housing for transferring toner from the reservoir to the developer unit. A shutter is slidably movable between a closed position blocking the outlet port and an open position unblocking the outlet port. The shutter is biased toward the closed position. The toner cartridge includes an engagement member having a rear end and a front end. The rear end is proximate to the rear of the housing and unobstructed to receive an actuation force from an actuation feature of the image forming device when the toner cartridge is installed in the image forming device. The front end is proximate to the front of the housing and movable between a position aligned with the shutter and a position unaligned with the shutter. The engagement member is movable from a first position to a second position upon receiving the actuation force. When the front end is in the unaligned position and the engagement member moves from the first position to the second position the front end of the engagement member protrudes from the front of the housing and bypasses the shutter. When the front end is in the aligned position and the engagement member moves from the first position to the second position the front end of the engagement member protrudes from the front of the housing and moves the shutter from the closed position to the open position.

A toner cartridge for use with a developer unit of an image forming device according to another example embodiment includes a housing having a front, a rear, a top and a bottom. The housing has a reservoir for holding toner. An outlet port on the front of the housing faces toward the bottom of the housing for transferring toner from the reservoir to the developer unit. A shutter is slidably movable between a closed position blocking the outlet port and an open position unblocking the outlet port. The shutter is biased toward the closed position. The toner cartridge includes a plunger having a rear end and a front end. The rear end is proximate to the rear of the housing and unobstructed to receive an actuation force from an actuation feature of the image forming device when the toner cartridge is installed in the image forming device. The front end is proximate to the front of the housing and movable between a position aligned with the shutter and a position unaligned with the shutter and positioned to engage a shutter on an inlet port of the developer unit when the toner cartridge is installed in the image forming device and mated with the developer unit. The plunger is movable from a first position to a second position upon receiving the actuation force. The plunger is biased toward the first position and the front end is biased toward the unaligned position. When the front end is in the unaligned position and the plunger moves from the first position to the second position the front end of the plunger protrudes from the front of the housing and bypasses the shutter of the toner cartridge. When the front end is in the aligned position and the plunger moves from the first position to the second position the front end of the plunger protrudes from the front of the housing and moves the shutter of the toner cartridge from the closed position to the open position and moves the shutter of the developer unit from a closed position to an open position when the toner cartridge is mated with the developer unit.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
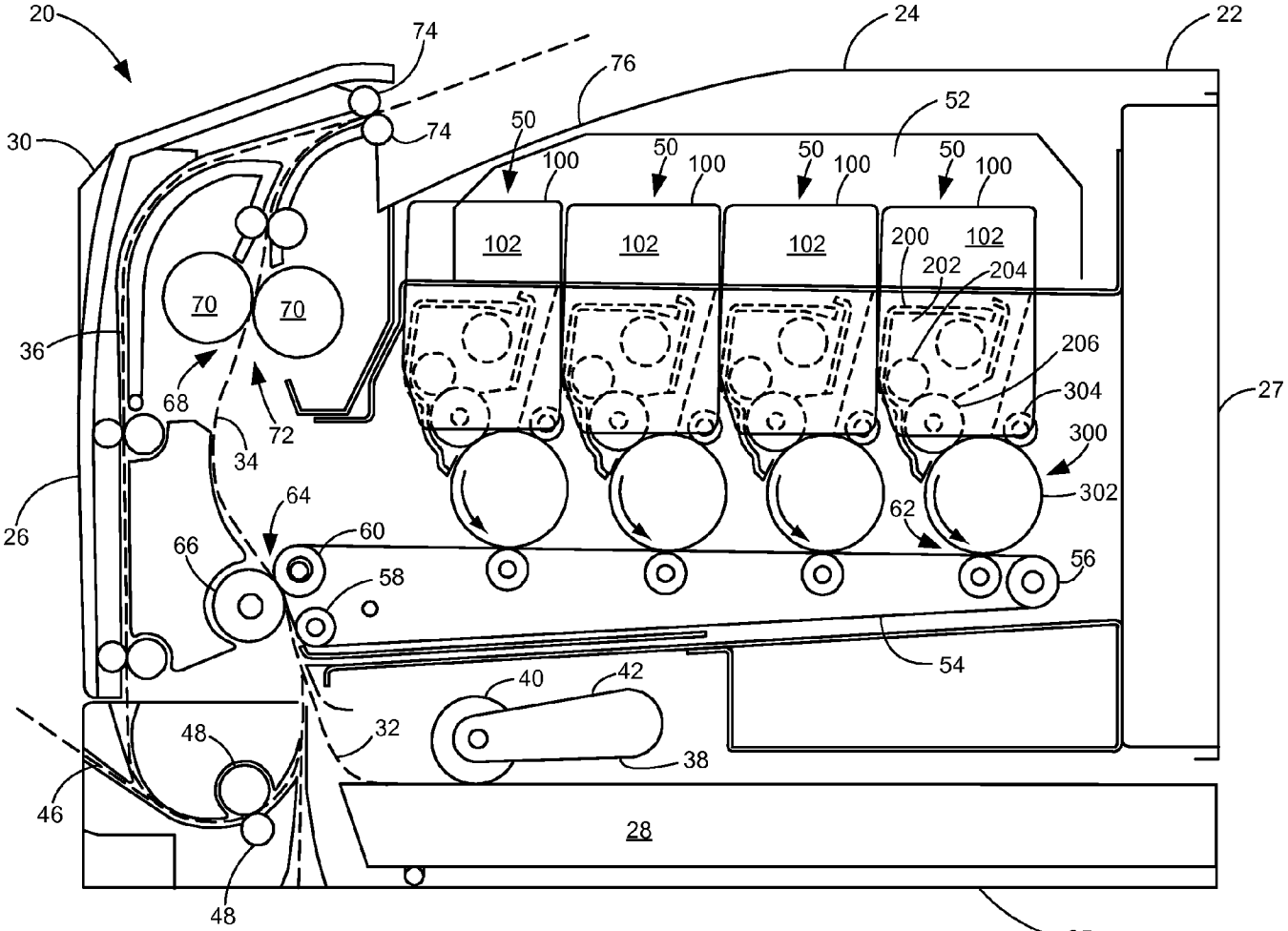
FIG. 1 is a schematic side view of the interior of an image forming device according to one example embodiment.

FIG. 1 illustrates a schematic view of the interior of an example image forming device 20. Image forming device 20 includes a housing 22 having a top 24, bottom 25, front 26 and rear 27. Housing 22 includes one or more input trays 28 positioned therein. Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel 30 may be located on housing 22. Using control panel 30, the user is able to enter commands and generally control the operation of the image forming device 20. For example, the user may enter commands to switch modes (e.g., color mode, monochrome mode), view the number of images printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rollers. Media sheets may also be introduced into media path 32 by a manual feed 46 having one or more rolls 48.

Image forming device 20 includes an image transfer section that includes one or more imaging stations 50. Each imaging station 50 includes a cartridge 100 and a developer unit 200 mounted on a common photoconductive unit 300. Each toner cartridge 100 includes a reservoir 102 for holding toner and an outlet port in communication with an inlet port of a corresponding developer unit 200 for transferring toner from reservoir 102 to developer unit 200 as discussed in greater detail below. One or more agitating members may be positioned within reservoir 102 to aid in moving the toner. Each developer unit 200 includes a toner reservoir 202 and a toner adder roll 204 that moves toner from reservoir 202 to a developer roll 206. The photoconductive unit 300 includes a charging roll 304 and a photoconductive (PC) drum 302 for each imaging station 50. PC drums 302 are mounted substantially parallel to each other. For purposes of clarity, developer unit 200, PC drum 302 and charging roll 304 are labeled on only one of the imaging stations 50. In the example embodiment illustrated, each imaging station 50 is substantially the same except for the color of toner.

Each charging roll 304 forms a nip with the corresponding PC drum 302. During a print operation, charging roll 304 charges the surface of PC drum 302 to a specified voltage such as, for example, −1000 volts. A laser beam from a printhead 52 associated with each imaging station 50 is then directed to the surface of PC drum 302 and selectively discharges those areas it contacts to form a latent image. In one embodiment, areas on PC drum 302 illuminated by the laser beam are discharged to approximately −300 volts. Developer roll 206, which forms a nip with the corresponding PC drum 302, then transfers toner to PC drum 302 to form a toner image. A metering device such as a doctor blade assembly can be used to meter toner onto developer roll 206 and apply a desired charge on the toner prior to its transfer to PC drum 302. The toner is attracted to the areas of PC drum 302 surface discharged by the laser beam from the printhead 52.

An intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 302 apply toner images in their respective colors to ITM 54 at a first transfer nip 62. In one embodiment, a positive voltage field attracts the toner image from PC drums 302 to the surface of the moving ITM 54. ITM 54 rotates and collects the one or more toner images from imaging stations 50 and then conveys the toner images to a media sheet at a second transfer nip 64 formed between a transfer roll 66 and ITM 54, which is supported by back-up roll 60. In an alternative embodiment, instead of using an ITM 54 to transfer toner from PC drums 302 to a media sheet, toner is transferred directly from each PC drum 302 to the media sheet as is known in the art.

A media sheet advancing through simplex path 34 receives the toner image from ITM 54 as it moves through the second transfer nip 64. The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, the exit rolls 74 move the media sheet from simplex path 34 to an output area 76 on top 24 of image forming device 20. In a reverse direction, exit rolls 74 move the media sheet into duplex path 36 for image formation on a second side of the media sheet.

Figure 2:
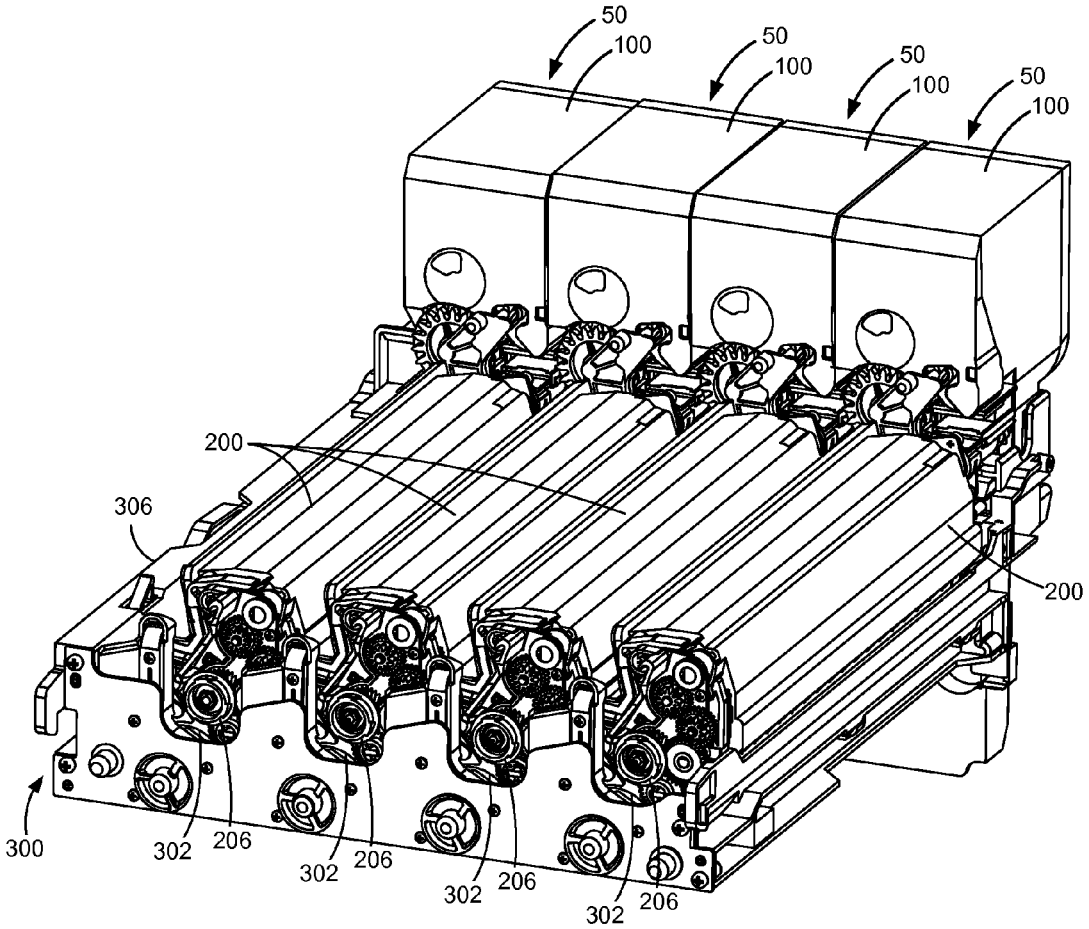
FIG. 2 is a perspective view of four imaging stations each having a toner cartridge and a developer unit for use with the image forming device according to one example embodiment.

A monocolor image forming device 20 may include a single imaging station 50, as compared to a color image forming device 20 that may include multiple imaging stations 50. FIG. 2 illustrates a set of four imaging stations 50 that each includes a respective cartridge 100, developer unit 200, and PC drum 302 mounted in a frame 306 of PC unit 300. In one embodiment, frame 306 is manufactured out of stamped metal plates that result in precise control of the location of PC drums 302 relative to one another and relative to ITM belt 54, printhead 52, and drive modules within image forming device 20. Frame 306 includes a central opening sized to receive developer units 200 and to mate developer rolls 206 with their respective PC drums 302.

Figure 3:
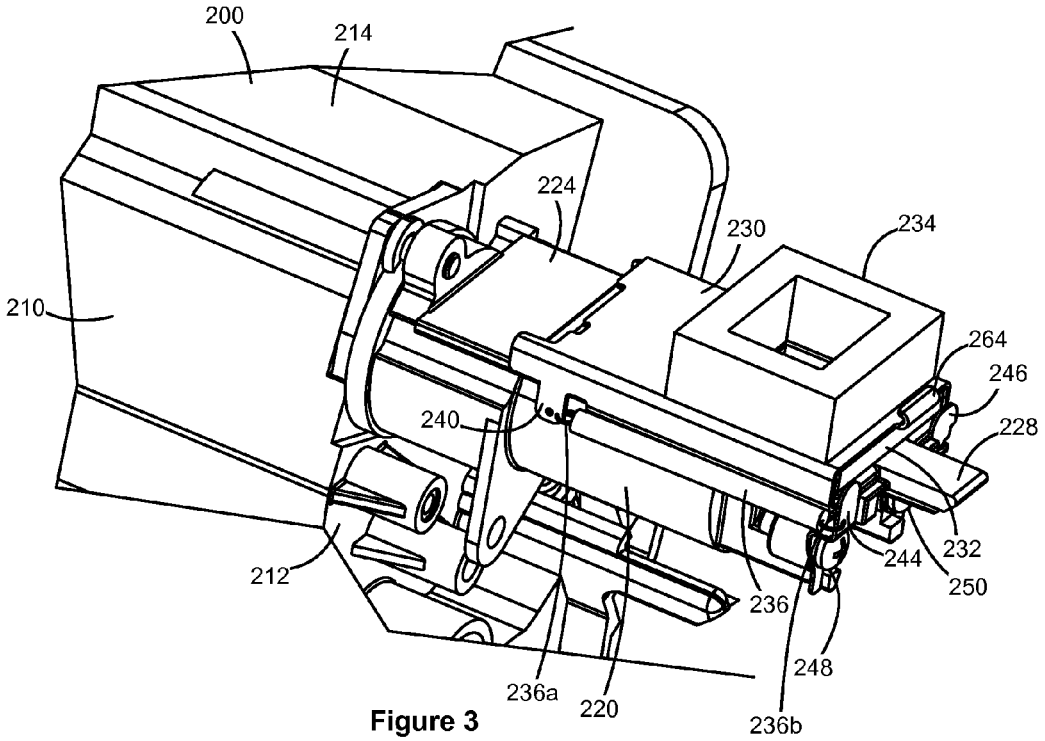
FIG. 3 is a perspective view of a shutter on an inlet port of the developer unit according to one example embodiment.

FIG. 3 shows a perspective view of a developer unit 200 in greater detail according to one example embodiment. Developer unit 200 is removably mounted in image forming device 20, such as in frame 306 discussed above. Reservoir 202, toner adder roll 204 and developer roll 206 discussed above are positioned within a housing 210 of developer unit 200. Housing 210 includes a shutter housing portion 220 that extends from a side portion 212 of developer housing 210. In one embodiment, shutter housing portion 220 is attached to a main housing portion 214 of developer housing 210 by suitable fasteners such as screws (not shown). Alternatively, shutter housing portion 220 may be ultrasonically welded to main housing portion 214 or formed integrally with main housing portion 214. A rotatable auger (not shown) protrudes from main housing portion 214 into shutter housing portion 220 in order to move toner from shutter housing portion 220 to main housing portion 214. Shutter housing portion 220 includes an inlet port 222 (FIGS. 5 and 6) that permits toner to enter developer unit 200 from cartridge 100. A shutter 230 is positioned on a top surface 224 of shutter housing portion 220 and is slidably movable between an open position (FIG. 6) and a closed position (FIG. 3). In the open position, shutter 230 permits toner to flow from cartridge 100 into developer unit 200 through inlet port 222. In the closed position, shutter 230 blocks inlet port 222 preventing toner from escaping developer unit 200.

A lower seal member 232 is attached to the bottom surface of shutter 230 and seals the interface between shutter 230 and shutter housing portion 220. An upper seal member 234 is attached to the top surface of shutter 230 and seals the interface between shutter 230 and cartridge 100 when cartridge 100 is installed. Lower seal member 232 and upper seal member 234 are movable with shutter 230. As shutter 230 slides between the closed position and the open position, lower seal member 232 slides against top surface 224 of shutter housing portion 220. In one embodiment, lower seal member 232 and upper seal member 234 are formed from an elastomeric foam material such as PORON® available from Rogers Corporation, Rogers, Conn., USA. However, lower seal member 232 and upper seal member 234 may be composed of any suitable material that provides an effective toner seal as long as shutter 230 is free to slide relative to shutter housing portion 220.

Figure 4:
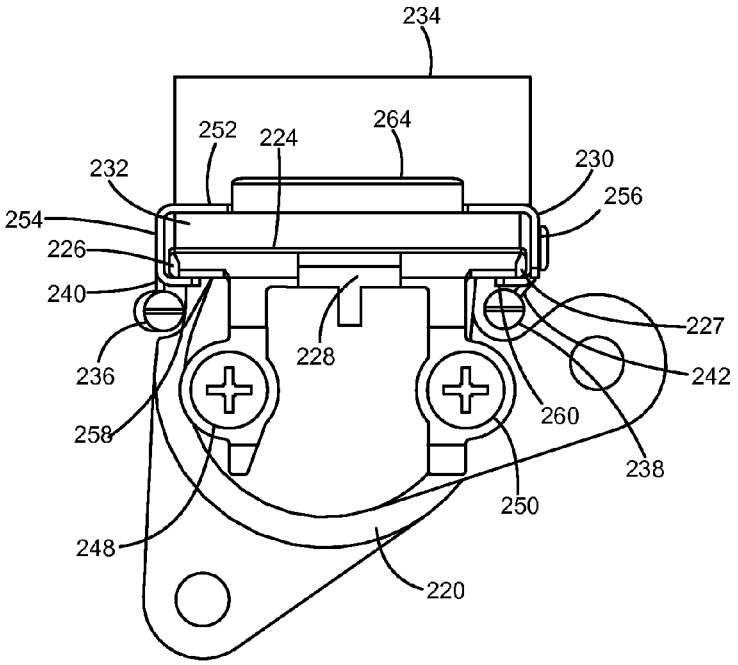
FIG. 4 is a side view of the shutter on the developer unit shown in FIG. 3.

With reference to FIGS. 3 and 4, extension springs 236, 238 are positioned on opposite sides of shutter 230 and bias shutter 230 toward the closed position shown in FIG. 3. Springs 236, 238 are connected at one end to legs that extend from shutter 230. FIG. 3 shows end 236*a* of spring 236 connected to leg 240 extending from shutter 230; the connection for spring 238 is substantially the same but is obscured in FIG. 3. The other ends of springs 236, 238 are connected to a respective anchor 244, 246 mounted on shutter housing portion 220. Again, end 236*b* of spring 236 is shown in FIG. 3 but spring 238 is not. In the example embodiment illustrated, anchors 244, 246 are mounted to shutter housing portion 220 by fasteners such as screws 248, 250, respectively; however, any suitable mounting method may be used such as by welding anchors 244, 246 to shutter housing portion 220 or by forming anchors 244, 246 integrally with shutter housing portion 220. Springs 236, 238 bias shutter 230 against anchors 244, 246. In addition to providing an attachment point for springs 236, 238, anchors 244, 246 serve as stops to limit the sliding motion of shutter 230 as it returns to the closed position shown in FIG. 3.

With reference to FIG. 4, a side view of shutter housing portion 220 is shown with shutter 230 mounted thereon. Anchors 244, 246 are removed from FIG. 4 in order to more clearly display the features of shutter 230 and shutter housing portion 220. As shown, shutter housing portion 220 includes a pair of ledges 226, 227 on opposite sides of inlet port 222. Shutter 230 includes a top portion 252 and a pair of side portions 254, 256 that extend downward from top portion 252. Legs 240, 242 are formed from a respective segment of each side portion 254, 256 proximate to main housing portion 214. Shutter 230 also includes a pair of tabs 258, 260 that extend from side portions 254, 256, respectively. Tabs 258, 260 wrap under and contact the bottom surface of ledges 226, 227, respectively. Lower seal member 232 is sandwiched between top portion 252 of shutter 230 and top surface 224 of shutter housing portion 220. In one embodiment, the distance from top surface 224 of shutter housing portion 220 to the bottom surface of top portion 252 of shutter 230 is less than the nominal thickness of lower seal member 232 such that lower seal member 232 is compressed to ensure that the interface between shutter 230 and shutter housing portion 220 is sealed. Shutter 230 includes a lip 264 formed at the edge of top portion 252 furthest from main housing portion 214. Lip 264 is positioned to receive an actuation force from an engagement feature on toner cartridge 100 to open shutter 230 when toner cartridge 100 is installed and an access door to image forming device 20 is closed as discussed in greater detail below.

Figure 5:
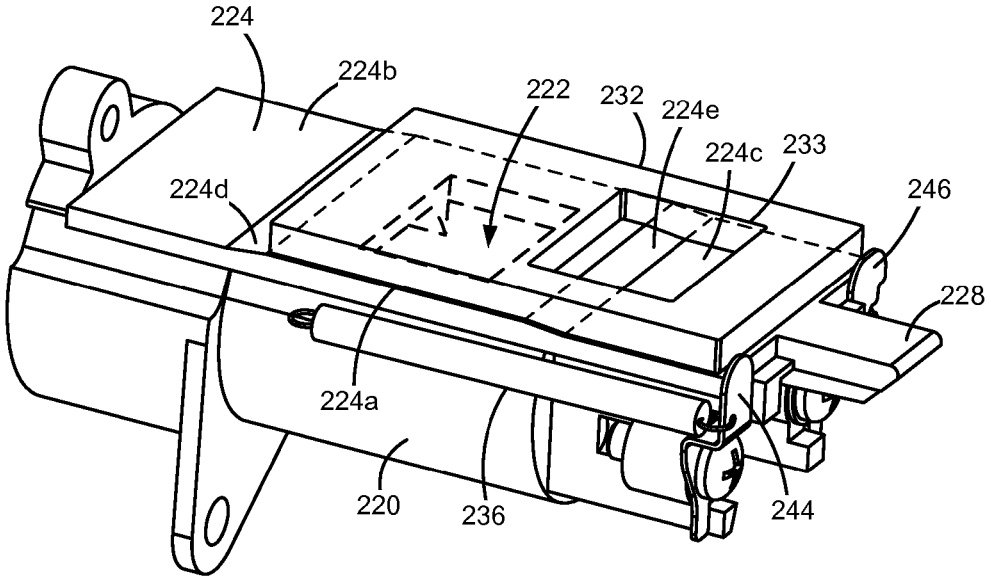
FIG. 5 is a perspective view of a lower seal member and a shutter housing for use with the developer unit shown in FIG. 3 according to one example embodiment.

FIG. 5 shows shutter housing portion 220 with shutter 230 and upper seal member 234 removed in order to more clearly illustrate lower seal member 232. Inlet port 222 is shown in dashed lines to illustrate its position on top surface 224 of shutter housing portion 220 beneath lower seal member 232. Lower seal member 232 is shown in the closed position with its body covering and blocking inlet port 222. Lower seal member 232 includes an opening 233 through an interior portion of its body that has a size and shape similar to that of inlet port 222. In the example embodiment illustrated, top surface 224 of shutter housing portion 220 includes a raised portion 224*a* that surrounds inlet port 222 to ensure that lower seal member 232 is sufficiently compressed to seal inlet port 222. The elevation of top surface 224 on each side of inlet port 222 in portions 224*b* and 224*c*, which are in the sliding path of shutter 230, is lower than raised portion 224*a* since sealing is less critical in these regions as compared with inlet port 222. Ramped portions 224*d*, 224*e* provide a gradual transition from portions 224*b*, 224*c*, respectively, to raised portion 224*a*. Reducing the elevation of top surface 224 in portions 224*b* and 224*c* decreases the compression of lower seal member 232 in those regions. This reduces unwanted drag on lower seal member 232 from top surface 224 during the actuation of shutter 230 and lowers the overall energy required to actuate shutter 230. In one embodiment, the elevation of raised portion 224*a* is about 0.25 mm higher than portions 224*b* and 224*c* and the nominal compression of lower seal member is about 0.6 mm.

Figure 6:
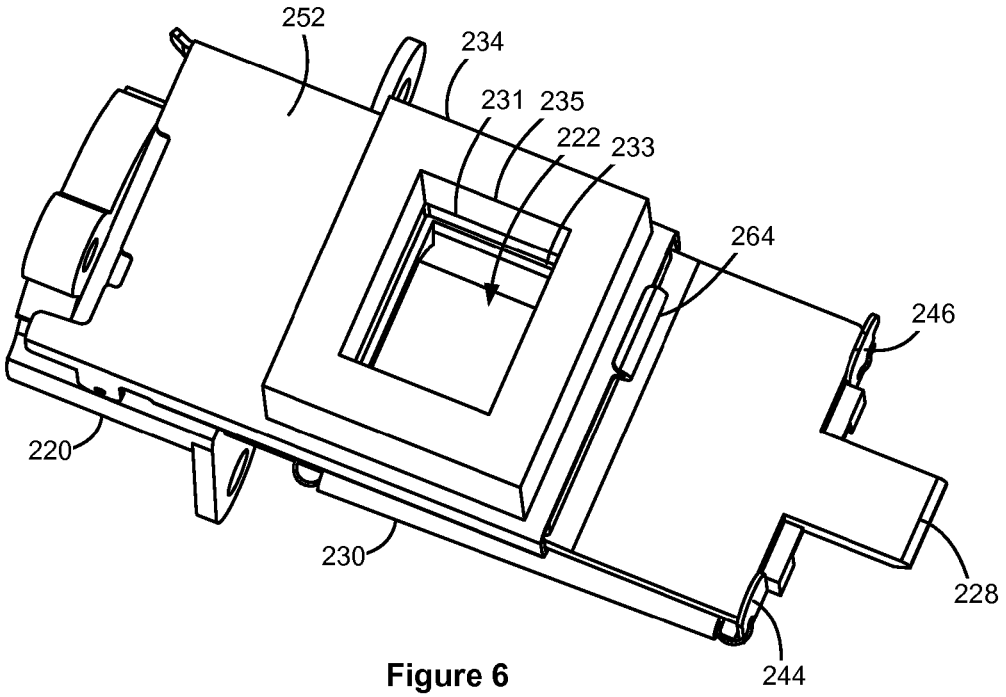
FIG. 6 is a perspective view of the shutter on the developer unit shown in FIG. 3 in the open position according to one example embodiment.

FIG. 6 shows a top perspective view of shutter 230 in the open position. Shutter 230 and upper seal member 234 include openings 231, 235, respectively, that are sized and shaped similar to opening 233 in lower seal member 232. As shutter 230 opens, shutter 230 slides to the left as viewed in FIG. 6 until openings 231, 233, 235 are positioned over inlet port 222 to permit toner to flow from toner cartridge 100 into shutter housing portion 220 so that it can then be drawn into main housing portion 214. Shutter housing portion 220 includes a protrusion or shelf 228 at the edge of shutter housing portion 220 furthest from main housing portion 214. As discussed in greater detail below, shelf 228 is positioned to raise an engagement feature on toner cartridge 100 to permit the engagement feature to contact lip 264 and actuate shutter 230 when toner cartridge 100 is installed and an access door to image forming device 20 is closed.

Figure 7:
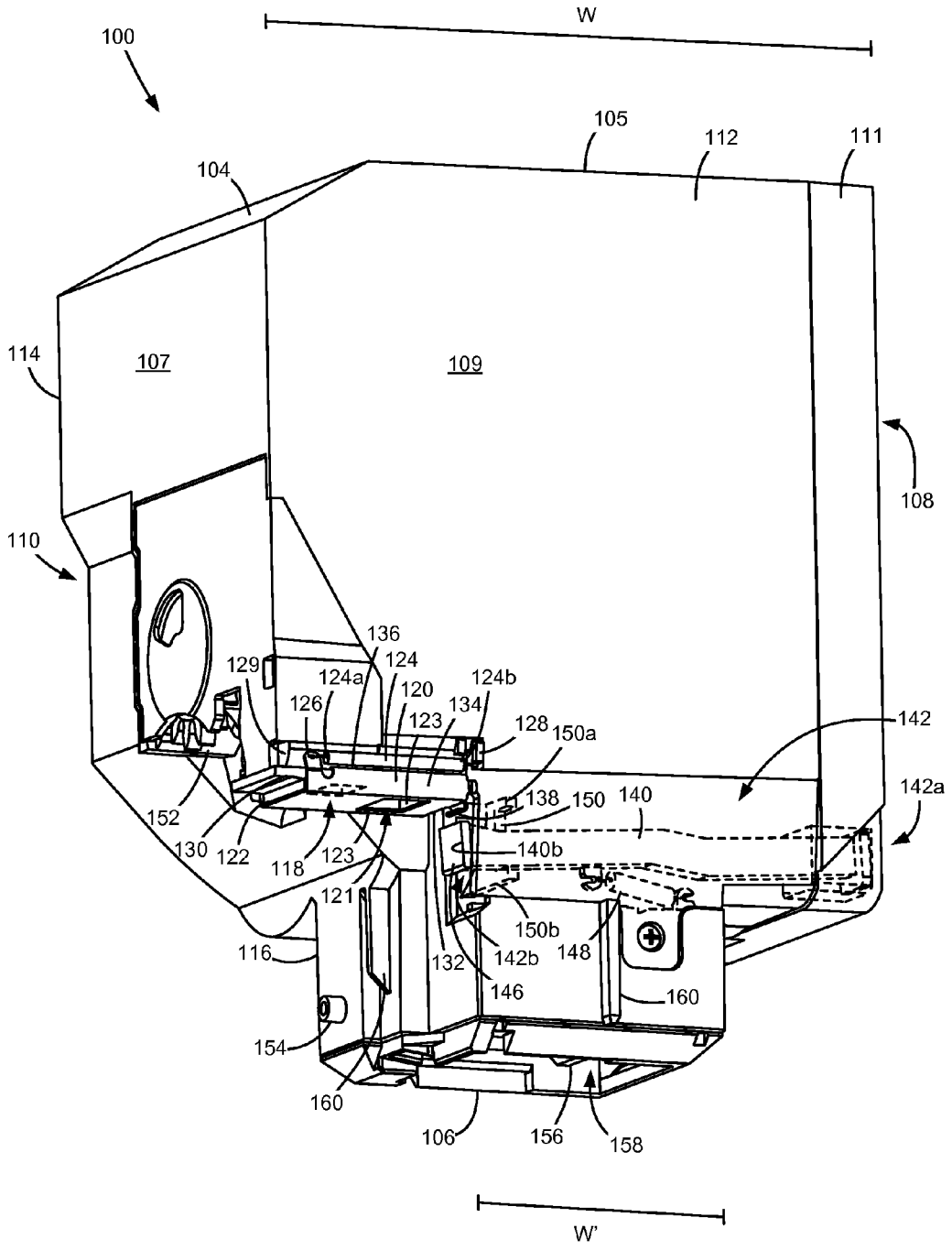
FIG. 7 is a front perspective view of a toner cartridge for use with the developer unit according to one example embodiment.

FIG. 7 shows a perspective view of toner cartridge 100. Toner cartridge 100 includes a housing 104 having a top 105, a bottom 106, a front 107, a rear 108 and a pair of sides 109, 110 and forming reservoir 102 therein. In one embodiment, housing 104 is comprised of an end cap 111 mounted on, such as by ultrasonic welding, a main housing 112 at the rear 108 of cartridge 100. Housing 104 includes a main section 114 and an extension section 116. Extension section 116 is positioned at the bottom 106 of housing 104. As illustrated in FIG. 7, a depth W' of extension section 116 measured between the front 107 and rear 108 is smaller than a depth W of main section 114. Toner cartridge 100 includes an overall height measured between the top 105 and the bottom 106. In one embodiment, extension section 116 includes a smaller height than main section 114.

Toner cartridge 100 includes an outlet port 118 for transferring toner to developer unit 200 through inlet port 222. Outlet port 118 is formed as a downward facing opening on main section 114 on the front 107 of housing 104. A shutter 120 is positioned on a bottom portion of main section 114 of housing 104 and is slidably movable between an open position and a closed position (shown in FIG. 7). In the open position, shutter 120 permits toner to flow from outlet port 118 of cartridge 100 through an opening 121 in shutter 120. In the closed position, shutter 120 blocks outlet port 118 to prevent toner from escaping cartridge 100.

A seal member 122 is positioned on a top surface of shutter 120 and seals the interface between shutter 120 and the bottom of main section 114 of housing 104. Seal member 122 is movable with shutter 120. Seal member 122 may be composed of the same material as lower seal member 232 or upper seal member 234 or a different suitable material. Like lower seal member 232 and upper seal member 234, seal member 122 includes an opening 123 that is sized and shaped to permit toner to flow from outlet port 118 into inlet port 222. Shutter 120 is biased toward the closed position blocking outlet port 118. For example, one or more extension springs 124 bias shutter 120 toward the closed position. In the example embodiment illustrated, springs 124 are connected at one end to a respective leg that extends from shutter 120. FIG. 7 shows end 124*a* of spring 124 connected to leg 126 extending from shutter 120; the connection for a second spring on the opposite side of shutter 120 is substantially the same but is obscured in FIG. 7. The other ends of springs 124 are connected to a respective anchor 128 on housing 104. Again, end 124*b* of spring 124 is shown in FIG. 7 but the second spring is not. Springs 124 bias shutter 120 against anchors 128. In addition to providing an attachment point for springs 124, anchors 128 serve as stops to limit the sliding motion of shutter 120 as it returns to the closed position. Additional stops 129 may be provided proximate to ends 124*a* of springs 124 to limit the sliding motion of shutter 120 as it opens.

In the example embodiment illustrated, the bottom of main section 114 of housing 104 includes a pair of ledges 130 on opposite sides of outlet port 118. In FIG. 7, only one of the pair of ledges 130 is shown; the other is obscured. Shutter 120 includes a bottom portion 132 and a pair of side portions 134 that extend upward from bottom portion 132. Again, FIG. 7 shows only one of the pair of side portions 134. Legs 126 are formed from a respective segment of each side portion 134 proximate to front 107 of housing 104. Shutter 120 also includes a pair of tabs 136 that extend from side portions 134, respectively. One of the pair of tabs 136 is shown in FIG. 7. Tabs 136 wrap over and ride along the top surfaces of ledges 130, respectively. Seal member 122 is sandwiched between bottom portion 132 of shutter 120 and the bottom of main section 114 of housing 104. In one embodiment, the distance from the bottom of main section 114 to the top surface of bottom portion 132 of shutter 120 is less than the nominal thickness of seal member 122 such that seal member 122 is compressed to ensure that the interface between shutter 120 and housing 104 is sealed. Shutter 120 includes a lip 138 formed at the edge of bottom portion 132 furthest from front 107. Lip 138 is positioned to receive an actuation force from the engagement feature on toner cartridge 100 to open shutter 120 when toner cartridge 100 is installed and an access door to image forming device 20 is closed as discussed in greater detail below. In one embodiment, the bottom of main section 114 of housing 104 includes a raised portion surrounding outlet port 118 similar to raised portion 224*a* of shutter housing portion 220 of developer unit 200 and ramped portions leading to the raised portion similar to ramped portions 224*d*, 224*e* of shutter housing portion 220 of developer unit 200.

Figure 8:
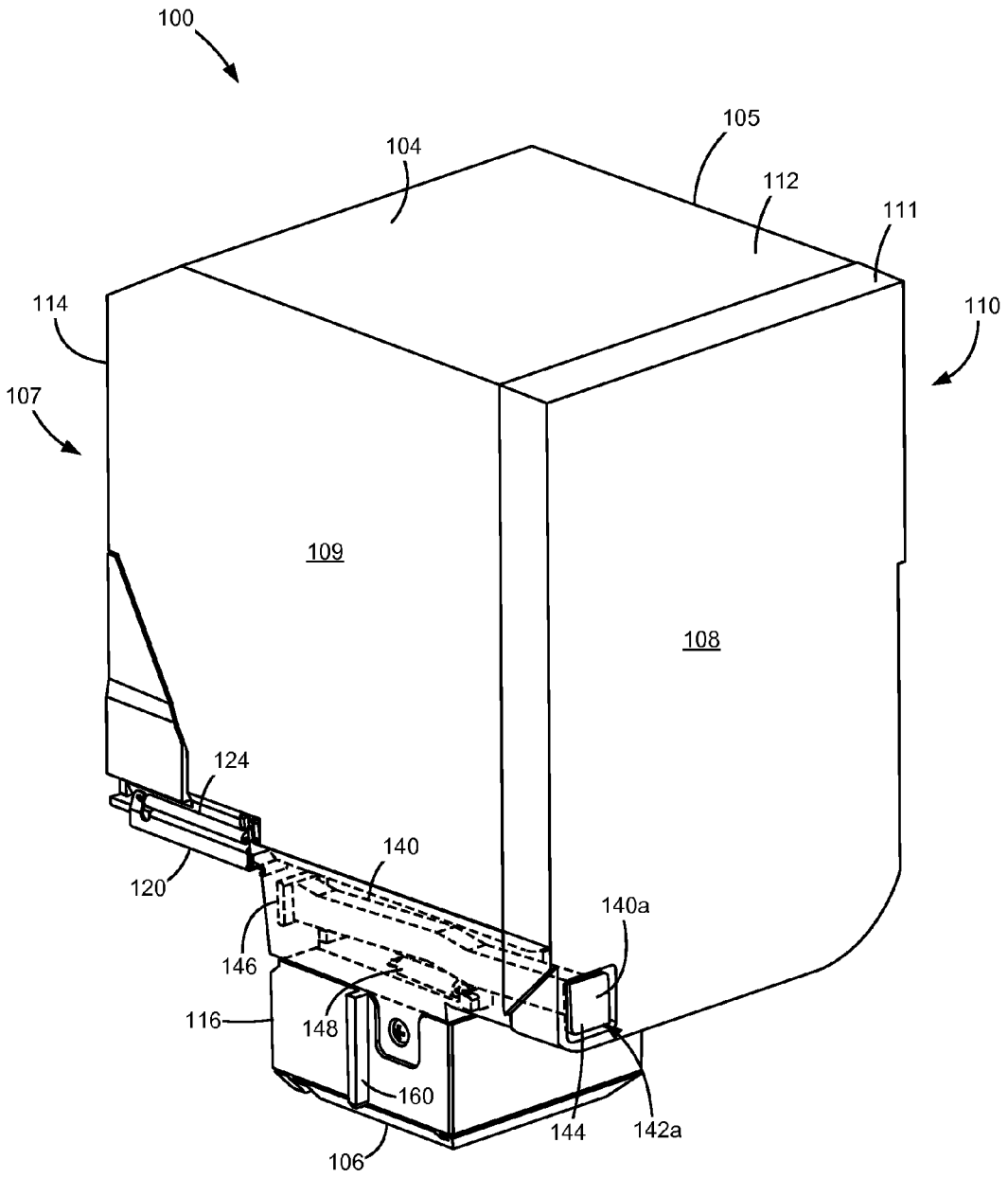
FIG. 8 is a rear perspective view of the toner cartridge shown in FIG. 7.

Toner cartridge 100 also includes an engagement member such as a plunger 140 that is positioned to open shutters 230, 120 when toner cartridge 100 is installed and mated with developer unit 200 and an access door to image forming device 20 is closed. Plunger 140 extends through a channel 142 in housing 104. Channel 142 extends from rear 108 of housing 104 to front 107 of housing 104 below outlet port 118. Channel 142 includes a rear opening 142*a* and a front opening 142*b*. With reference to FIG. 8, a rear end 140*a* of plunger 140 is exposed at rear opening 142*a* of channel 142 to receive an actuation force from an actuation member, such as a plunger, rib, projection, arm, etc., operatively coupled to an access door of image forming device 20 as explained in greater detail below. In the example embodiment illustrated, rear end 140*a* of plunger 140 includes an engagement surface 144, such as a button-like area or contact face, that engages the actuation member of image forming device 20. With reference back to FIG. 7, a front end 140*b* of plunger 140 is exposed at front opening 142*b* of channel 142 to allow plunger 140 to contact shutters 120, 230 and push shutters 120, 230 from their closed positions to their open positions as explained in greater detail below. Front end 140*b* of plunger 140 is movable (e.g., vertically toward and away from top 105 and bottom 106) between a position aligned with shutter 120 and a position unaligned with shutter 120. In the example embodiment illustrated, front end 140*b* of plunger 140 includes an engagement surface 146, such as a substantially planar contact face, that provides sufficient contact with shutters 120, 230. Plunger 140 is biased by one or more biasing members, such as an extension spring 148, toward rear 108 of housing 104 with rear end 140*a* of plunger 140 exposed to receive the actuation member of image forming device 20. In the example embodiment illustrated, spring 148 is connected at one end to plunger 140 and at the other end to a portion of housing 104 within channel 142. Spring 148 may also bias front end 140*b* of plunger 140 toward the unaligned position with respect to shutter 120 (a lowered position in the example embodiment illustrated). In the example embodiment illustrated, a guide 150 positioned within channel 142 includes top and bottom stops 150*a*, 150*b* that define the vertical movement of front end 140*b* of plunger 140.

Toner cartridge 100 further includes a drive gear 152 positioned on the front 107 of housing 104. Drive gear 152 meshes with and receives rotational power from a corresponding gear in image forming device 20 in order to provide rotational power to various paddles and/or agitators and an auger positioned within reservoir 102 for moving toner to outlet port 118. In the example embodiment illustrated, drive gear 152 is partially covered with only a few teeth exposed on a bottom portion thereof. Drive gear 152 is positioned on main section 114 of housing 104 above outlet port 118.

Where multiple toner cartridges 100 are used with a single image forming device 20, toner cartridge 100 may include a keying structure 154 that prevents a toner cartridge 100 from being inserted in the wrong location. For example, where each toner cartridge 100 in image forming device 20 provides a different color toner, such as where toner cartridges having black, cyan, yellow and magenta toners are used, keying structure 154 prevents each toner cartridge 100 from being inserted into the location corresponding with any other color. For example, keying structure 154 may prevent a toner cartridge 100 containing cyan colored toner from being positioned in the location for a black, yellow or magenta toner cartridge. In the example embodiment illustrated, keying structure 154 is positioned on the front 107 of extension section 116 of housing 104.

Toner cartridge 100 may also include an electrical connector 156 having processing circuitry for communicating with a controller of image forming device 20. The processing circuitry may provide authentication functions, safety and operational interlocks, operating parameters and usage information related to toner cartridge 100. In the example embodiment illustrated, electrical connector 156 is positioned in a recess 158 in the bottom 106 of housing 104. When toner cartridge 100 is installed in image forming device 20, contacts on electrical connector 156 mate with corresponding contacts of image forming device 20 to establish a communication link to the controller of image forming device 20.

Toner cartridge 100 may also include various alignment members 160 that align toner cartridge 100 with developer unit 200 during insertion of toner cartridge 100 in the direction shown by arrow A in FIG. 7. For example, alignment members 160 may include a combination of projections that project outwardly from sides 109, 110 and/or front 107 of housing 104 and/or elongated slots formed as depressions in sides 109, 110 and/or front 107 that mate with corresponding slots and/or projections, respectively, to ensure accurate positioning of toner cartridge 100. For example, alignment members 160 help ensure that outlet port 118 mates with inlet port 222 of developer unit 200, that drive gear 152 mates with the corresponding drive gear in image forming device 20, and that electrical connector 156 mates with corresponding electrical contacts.

Figure 9:
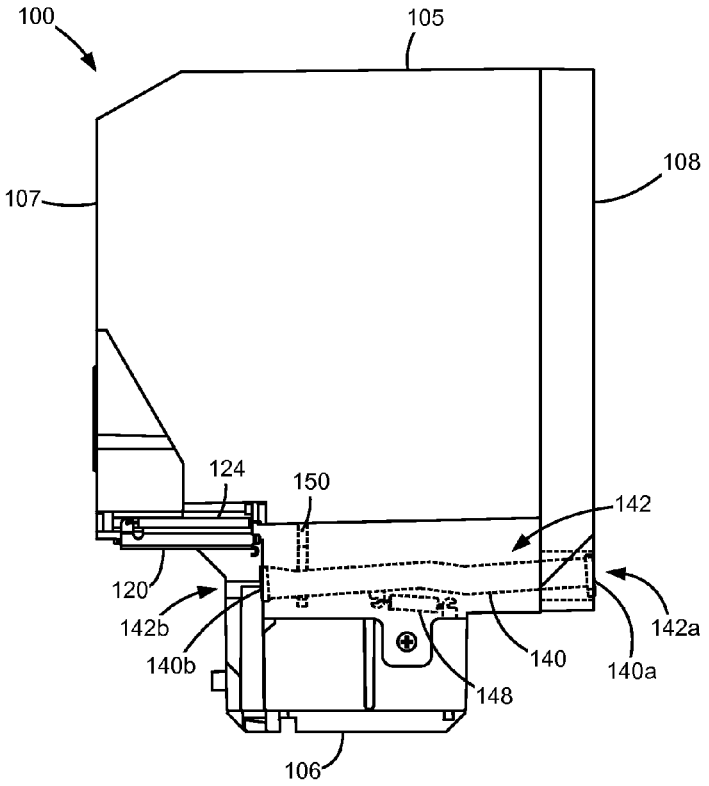
FIG. 9 is a side elevation view of the toner cartridge shown in FIG. 7 showing a plunger in its home position according to one example embodiment.

FIGS. 9-14 illustrate the operation of shutters 120, 230 according to one example embodiment. FIG. 9 shows toner cartridge 100 with plunger 140 in its home position biased toward rear opening 142*a* by spring(s) 148. As shown, in this position, front end 140*b* of plunger 140 is spaced below and toward rear 108 from shutter 120, unaligned with shutter 120. Rear end 140*a* of plunger 140 is exposed through rear opening 142*a* of channel 142 to receive an actuation force from the actuation member coupled to the access door of image forming device 20.

Figure 10:
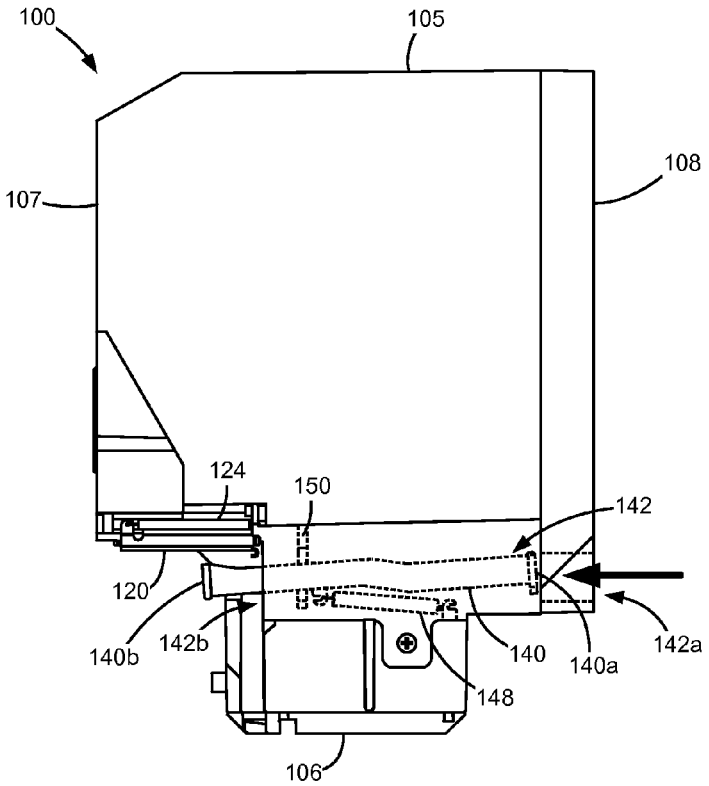
FIG. 10 is a side elevation view of the toner cartridge shown in FIG. 7 showing the plunger depressed when the toner cartridge is not mated with a corresponding developer unit according to one example embodiment.

FIG. 10 shows toner cartridge 100 with plunger 140 depressed in the direction indicated by the arrow shown in FIG. 10 when toner cartridge 100 is not mated with developer unit 200. For example, in FIG. 10, toner cartridge 100 may not be installed in image forming device 20 and plunger 140 may be depressed manually at rear end 140*a* by a user. Alternatively, toner cartridge 100 may be installed in image forming device 20 without its corresponding developer unit 200 present and plunger 140 may be depressed at rear end 140*a* by the actuation member coupled to the access door of image forming device 20. As shown, when toner cartridge 100 is not mated with developer unit 200 and plunger 140 is depressed overcoming the bias applied by spring 148, plunger 140 moves forward (toward front 107) and bypasses shutter 120 leaving shutter 120 in the closed position. Specifically, in this embodiment, front end 140*b* of plunger 140 passes below shutter 120 without contacting shutter 120. This prevents shutter 120 from opening and toner from escaping outlet port 118 unless toner cartridge 100 is mated with developer unit 200 in its final position in image forming device 20. When the access door of image forming device 20 is opened (or the user manually depressing plunger 140 releases plunger 140) the bias applied by spring 148 returns plunger 140 to its home position shown in FIG. 9.

Figure 11:
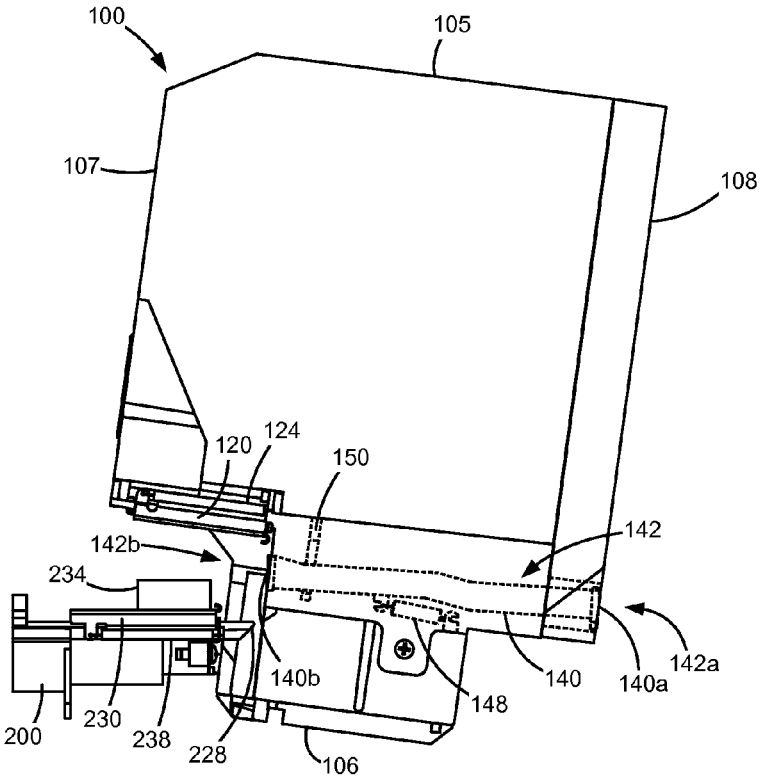
FIGS. 11 and 12 are sequential side elevation views of the toner cartridge shown in FIG. 7 being installed in the image forming device and mated with the developer unit shown in FIG. 3 according to one example embodiment.
Figure 12:
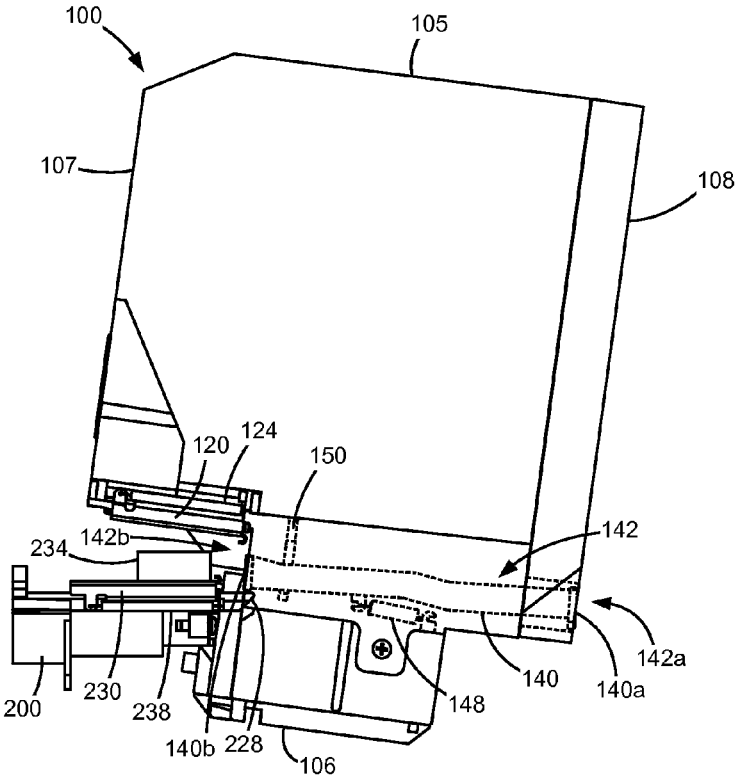

FIG. 11 shows toner cartridge 100 with PC unit 300 removed for clarity as toner cartridge 100 approaches developer unit 200 during installation of toner cartridge 100 in image forming device 20. Toner cartridge 100 approaches developer unit 200 from above in a generally downward direction. For example, in the example embodiment shown, toner cartridge 100 rotates forward as it approaches developer unit 200. FIG. 12 shows toner cartridge 100 as it continues its advance toward developer unit 200 again with PC unit 300 removed for clarity. As shown in FIG. 12, as toner cartridge 100 approaches developer unit 200, shelf 228 on shutter housing portion 220 of developer unit 200 contacts an underside of plunger 140 raising front end 140*b* of plunger 140 toward top 105 of housing 104 as toner cartridge 100 continues to advance toward developer unit 200.

Figure 13:
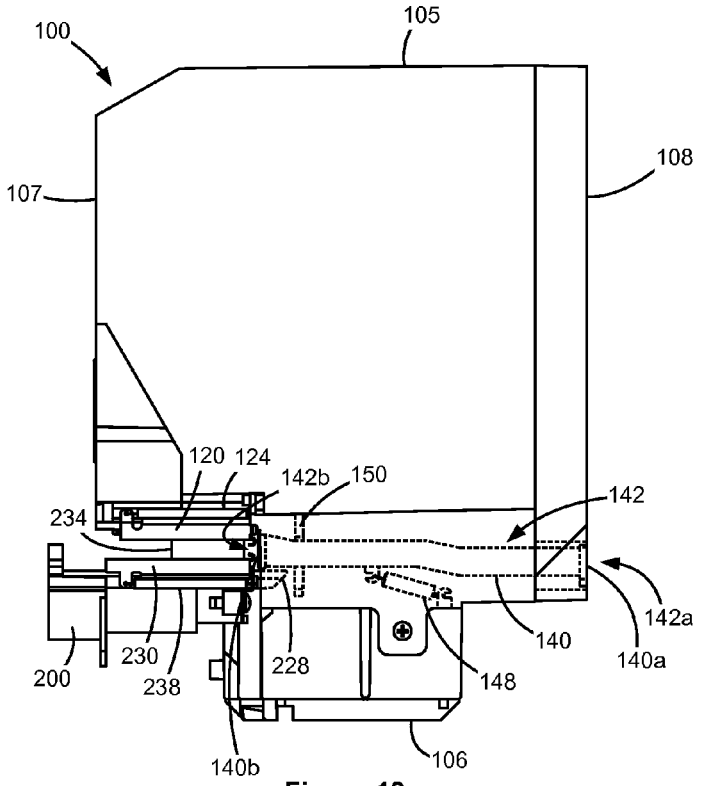
FIG. 13 is a side elevation view of the toner cartridge shown in FIG. 7 installed in the image forming device and mated with the developer unit shown in FIG. 3 with the plunger in its home position according to one example embodiment.

FIG. 13 shows toner cartridge 100 in its final installed position, mated with developer unit 200 again with PC unit 300 removed for clarity. The access door (not shown) of image forming device is open leaving shutters 120, 230 in their closed positions and plunger 140 in its home position. Shutter 120 is mated with upper seal member 234 to prevent toner leakage between toner cartridge 100 and developer unit 200. Opening 121 in shutter 120 of toner cartridge 100 is aligned with opening 235 in upper seal member 234 of shutter 230 of developer unit 200. Front end 140*b* of plunger 140 has been raised by shelf 228 into horizontal alignment with shutters 120 and 230 so that front end 140*b* may contact shutters 120, 230 upon being actuated by the actuation member coupled to the access door of image forming device 20.

Figure 14:
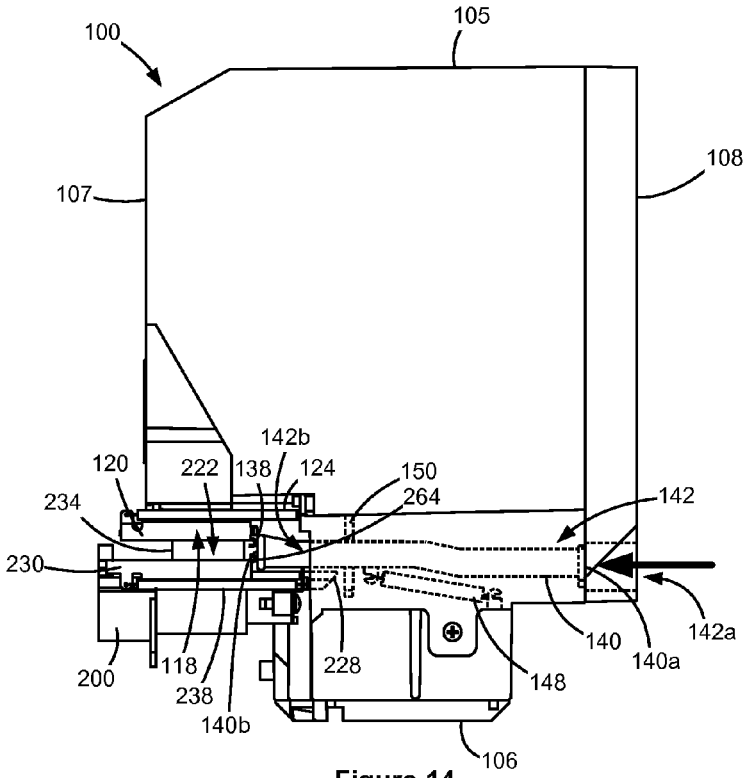
FIG. 14 is a side elevation view of the toner cartridge shown in FIG. 7 installed in the image forming device and mated with the developer unit shown in FIG. 3 with the plunger depressed to open a shutter of the toner cartridge and a shutter of the developer unit according to one example embodiment.

FIG. 14 shows the actuation of plunger 140 by the actuation member coupled to the access door of image forming device 20 in the direction shown by the arrow. Specifically, when the access door is closed, the actuation member coupled to the access door contacts rear end 140*a* of plunger 140 and overcomes the biasing force of spring 148 to depress plunger 140 toward front 107. As plunger 140 advances, plunger 140 contacts shutter 120 of toner cartridge 100 and shutter 230 of developer unit 200. As plunger 140 advances further, plunger 140 pushes shutters 120, 230 forward (to the left as viewed in FIG. 14) from their closed positions to the open positions of shutters 120, 230. In the open positions of shutters 120, 230, opening 121 of shutter 120 is aligned with outlet port 118 and opening 231 of shutter 230 is aligned with inlet port 222 to allow toner to flow from toner cartridge 100 into developer unit 200. Specifically, in the example embodiment illustrated, front end 140*b* of plunger 140 contacts lip 138 of shutter 120 and lip 264 of shutter 230 as plunger 140 pushes against shutters 120, 230, respectively.

When the access door of image forming device 20 is opened, the actuation member retracts from rear end 140*a* of plunger 140 causing plunger 140 to retract to its home position (as shown in FIG. 13) as a result of the bias applied by spring 148 thereby closing shutters 120 and 230 with shutter 120 and upper seal member 234 still engaged to prevent toner leakage. As toner cartridge 100 is removed from image forming device 20, shutter 120 separates from upper seal member 234 and front end 140*b* of plunger 140 lowers and separates from shelf 228 to the unaligned position with respect to shutter 120 as shown in reverse order in FIGS. 12 and 11.

Accordingly, the arrangement of plunger 140 prevents shutter 120 from opening unless toner front end 140*b* of plunger 140 is raised into horizontal alignment with shutter 120 and rear end 140*a* of plunger 140 is engaged. This prevents shutter 120 from opening unless cartridge 100 is installed in its final position in image forming device 20 and mated with developer unit 200. If shutter 120 was opened without developer unit 200 present, toner would be able to escape toner cartridge 100 through outlet port 118 into the internal area of image forming device 20 potentially causing print defects. The arrangement of plunger 140 prevents this from happening. Further, prior to insertion of toner cartridge 100 in image forming device 20, users may be tempted to press engagement surface 144 without realizing its function. The arrangement of plunger 140 prevents a user from accidently opening shutter 120 when toner cartridge 100 is not installed in image forming device 20. Similarly, when toner cartridge 100 is inserted into image forming device 20 and mated with developer unit 200, shutter 120 will remain closed until the access door of image forming device 20 is closed indicating that the device is ready to print.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge, comprising:

a housing having a front, a rear, a top and a bottom, the housing having a reservoir for holding toner;

an outlet port on the front of the housing for exiting toner from the toner cartridge; and an engagement member having a first engagement surface and a second engagement surface, the first engagement surface positioned proximate to the rear of the housing and positioned to receive an actuation force in a frontward direction relative to the housing at the rear of the housing, the second engagement surface positioned proximate to the front of the housing below the outlet port, the engagement member being movable from a first position to a second position upon receiving the actuation force, wherein as the engagement member moves from the first position to the second position, the second engagement surface moves in the frontward direction relative to the housing and protrudes from the front of the housing with at least a portion of the front of the second engagement surface unobstructed.

2. The toner cartridge of claim 1, wherein the engagement member is biased toward the rear of the housing, toward the first position.

3. The toner cartridge of claim 1, further comprising a channel extending from the front of the housing to the rear of the housing, the engagement member being positioned within the channel, the channel having a rear opening at the rear of the housing and a front opening at the front of the housing, the first engagement surface being exposed at the rear opening and the second engagement surface being exposed at the front opening.

4. The toner cartridge of claim 1, further comprising a shutter on the housing of the toner cartridge slidably movable between a closed position blocking the outlet port and an open position unblocking the outlet port, the shutter of the toner cartridge being biased toward the closed position, wherein as the engagement member moves from the first position to the second position, the second engagement surface moves the shutter from the closed position to the open position.

5. The toner cartridge of claim 4, wherein the second engagement surface is movable between a position aligned with the shutter and a position unaligned with the shutter, wherein when the second engagement surface is in the unaligned position and the engagement member moves from the first position to the second position the second engagement surface moves in the frontward direction relative to the housing and protrudes from the front of the housing and bypasses the shutter, wherein when the second engagement surface is in the aligned position and the engagement member moves from the first position to the second position the second engagement surface moves in the frontward direction relative to the housing and protrudes from the front of the housing and moves the shutter from the closed position to the open position.

6. The toner cartridge of claim 5, wherein the second engagement surface is biased toward the unaligned position.

7. The toner cartridge of claim 5, wherein the unaligned position of the second engagement surface is a lowered position and the aligned position of the second engagement surface is a raised position, wherein when the second engagement surface bypasses the shutter the second engagement surface passes below the shutter.

8. The toner cartridge of claim 7, wherein the second engagement surface is biased toward the lowered position.

9. The toner cartridge of claim 1, wherein the engagement member includes a single engagement member having the first engagement surface and the second engagement surface.

10. A toner cartridge, comprising:

a housing having a front, a rear, a top and a bottom, the housing having a reservoir for holding toner;

an outlet port on the front of the housing facing toward the bottom of the housing for exiting toner from the toner cartridge;

a shutter slidably movable between a closed position blocking the outlet port and an open position unblocking the outlet port, the shutter being biased toward the closed position; and an engagement member having a first engagement surface and a second engagement surface, the first engagement surface being proximate to the rear of the housing and unobstructed to receive an actuation force in a frontward direction relative to the housing at the rear of the housing, the second engagement surface being proximate to the front of the housing and movable between a position aligned with the shutter and a position unaligned with the shutter, the engagement member is movable from a first position to a second position upon receiving the actuation force, wherein when the second engagement surface is in the unaligned position and the engagement member moves from the first position to the second position the second engagement surface of the engagement member moves in the frontward direction relative to the housing and protrudes from the front of the housing and bypasses the shutter, and when the second engagement surface is in the aligned position and the engagement member moves from the first position to the second position the second engagement surface of the engagement member moves in the frontward direction relative to the housing and protrudes from the front of the housing and moves the shutter from the closed position to the open position.

11. The toner cartridge of claim 10, wherein the engagement member is biased toward the rear of the housing, toward the first position.

12. The toner cartridge of claim 10, further comprising a channel extending from the front of the housing to the rear of the housing, the engagement member being positioned within the channel, the channel having a rear opening at the rear of the housing and a front opening at the front of the housing, the first engagement surface of the engagement member being exposed at the rear opening and the second engagement surface of the engagement member being exposed at the front opening.

13. The toner cartridge of claim 10, wherein the engagement member includes a single engagement member having the first engagement surface and the second engagement surface.

14. A toner cartridge, comprising:

a housing having a front, a rear, a top and a bottom, the housing having a reservoir for holding toner;

an outlet port on the front of the housing for exiting toner from the toner cartridge; and a plunger having a rear engagement surface and a front engagement surface, the rear engagement surface positioned proximate to the rear of the housing and positioned to receive an actuation force in a frontward direction relative to the housing at the rear of the housing, the front engagement surface positioned proximate to the front of the housing, the plunger being movable from a first position to a second position upon receiving the actuation force, wherein as the plunger moves from the first position to the second position, the front engagement surface moves in the frontward direction relative to the housing and protrudes from the front of the housing directly below the outlet port with at least a portion of the front engagement surface unobstructed to permit the front engagement surface to contact and push a shutter of a developer unit in the frontward direction relative to the housing when the toner cartridge is installed in an image forming device and mated with the developer unit.

15. The toner cartridge of claim 14, wherein the plunger is biased toward the rear of the housing, toward the first position.

16. The toner cartridge of claim 14, further comprising a channel extending from the front of the housing to the rear of the housing, the plunger being positioned within the channel, the channel having a rear opening at the rear of the housing and a front opening at the front of the housing, the rear engagement surface being exposed at the rear opening and the front engagement surface being exposed at the front opening.

17. The toner cartridge of claim 14, further comprising a shutter on the housing of the toner cartridge slidably movable between a closed position blocking the outlet port and an open position unblocking the outlet port, the shutter of the toner cartridge being biased toward the closed position, wherein as the plunger moves from the first position to the second position, the front engagement surface contacts and pushes the shutter of the toner cartridge from the closed position to the open position.

18. The toner cartridge of claim 17, wherein the front engagement surface is movable between a position aligned with the shutter of the toner cartridge and a position unaligned with the shutter of the toner cartridge, wherein when the front engagement surface is in the unaligned position and the plunger moves from the first position to the second position the front engagement surface moves in the frontward direction relative to the housing and protrudes from the front of the housing and bypasses the shutter of the toner cartridge, wherein when the front engagement surface is in the aligned position and the plunger moves from the first position to the second position the front engagement surface moves in the frontward direction relative to the housing and protrudes from the front of the housing and contacts and pushes the shutter of the toner cartridge from the closed position to the open position.

19. The toner cartridge of claim 18, wherein the front engagement surface is biased toward the unaligned position.

20. The toner cartridge of claim 18, wherein the unaligned position of the front engagement surface is a lowered position and the aligned position of the front engagement surface is a raised position, wherein when the front engagement surface bypasses the shutter of the toner cartridge the front engagement surface passes below the shutter of the toner cartridge.

* * * * *